United States Patent [19]

Schilling et al.

[11] Patent Number: 4,998,877

[45] Date of Patent: Mar. 12, 1991

[54] BLOWER BURNER

[75] Inventors: Jürgen Schilling, Wermelskirchen; Horst Reichmann, Wuppertal; Wolfgang Henche, Remscheid; Thomas Pieper, Wermelskirchen; Bernd Braun, Remscheid; Hans Ludowisy, Solingen, all of Fed. Rep. of Germany

[73] Assignee: Joh. Vaillant GmbH und Co., Remscheid, Fed. Rep. of Germany

[21] Appl. No.: 877,733

[22] Filed: Jun. 24, 1986

Related U.S. Application Data

[63] Continuation of Ser. No. 626,312, Jun. 29, 1984, abandoned.

[30] Foreign Application Priority Data

| | | | |
|---|---|---|---|
| Oct. 29, 1982 | [DE] | Fed. Rep. of Germany | 8230410[U] |
| Dec. 16, 1982 | [DE] | Fed. Rep. of Germany | 8235312[U] |
| Feb. 26, 1983 | [DE] | Fed. Rep. of Germany | 8305799[U] |
| Mar. 4, 1983 | [DE] | Fed. Rep. of Germany | 8306221[U] |
| Mar. 19, 1983 | [DE] | Fed. Rep. of Germany | 8308544[U] |
| Jun. 22, 1983 | [DE] | Fed. Rep. of Germany | 8318419[U] |
| Jul. 6, 1983 | [DE] | Fed. Rep. of Germany | 8319776[U] |

[51] Int. Cl.[5] ..... F23N 1/00; F23D 11/36

[52] U.S. Cl. ..... 431/19; 431/114; 431/89; 431/188; 431/243; 431/265

[58] Field of Search ..... 431/114, 19, 89, 185, 431/186, 187, 188, 182, 183, 353, 350, 265, 243; 98/DIG. 10; 181/224, 225, 277, 270, 204, 205; 60/39, 23, 725

[56] References Cited

U.S. PATENT DOCUMENTS

| | | | |
|---|---|---|---|
| 818,256 | 4/1906 | Kemp | 431/188 |
| 1,993,901 | 3/1935 | Silley | 431/188 |
| 2,224,544 | 12/1940 | Keller | 236/15 |
| 2,446,744 | 8/1984 | De Lancey | 431/265 X |
| 2,781,829 | 2/1957 | Zucker et al. | 431/114 |
| 3,051,228 | 8/1962 | Peoples et al. | 431/265 X |
| 3,463,602 | 8/1969 | Bitterlich et al. | 431/188 |
| 3,649,155 | 3/1972 | Sharan | 431/19 |
| 3,732,057 | 5/1973 | Lipper et al. | 431/19 |
| 3,748,085 | 7/1973 | Poepsel et al. | 431/114 |
| 4,095,929 | 6/1978 | McCartney | 431/19 |
| 4,151,711 | 5/1979 | Fromm et al. | 431/188 X |
| 4,203,718 | 5/1980 | Tracy | 431/188 |
| 4,519,769 | 5/1985 | Tanaka | 431/4 |

FOREIGN PATENT DOCUMENTS

| | | | |
|---|---|---|---|
| 481049 | 2/1952 | Canada | 431/265 |
| 462547 | 6/1928 | Fed. Rep. of Germany | 431/188 |
| 2048642 | 4/1972 | Fed. Rep. of Germany | 431/114 |
| 1272148 | 4/1902 | France | 431/188 |
| 150715 | 9/1982 | Japan | 431/114 |
| 248279 | 3/1964 | Netherlands | 431/183 |
| 595590 | 2/1978 | U.S.S.R. | 431/188 |
| 653786 | 5/1951 | United Kingdom | 431/188 |

*Primary Examiner*—Alan Cohan
*Assistant Examiner*—Allen J. Flanigan
*Attorney, Agent, or Firm*—Horst M. Kasper

[57] ABSTRACT

A blower burner is provided for a boiler heated with fluid fuels with a blower casing, which incorporates on one side the blower with the attached drive motor and where the fire tube of the burner comes out on the other side. The motor and the fire tube form protruding parts on opposite sides of the blower housing. The rear side of the fire tube protrudes beyond the side of the casing disposed toward the drive motor and the rear side of the fire tube protrudes into a cover extension attachment of the blower casing. The burner is provided with a pressure controller, where the air pressure inside of the fire tube element is measured by the input sensor signal and where the blower speed is the variable controlled by the pressure controller. Furthermore, a sound absorbing means is provided for the blower burner.

39 Claims, 9 Drawing Sheets

BLOWER BURNER

This is a continuation of application Ser. No. 626,312, filed June 29, 1984, now abandoned.

BACKGROUND OF THE INVENTION

1. Field of the Invention

The present invention relates to a burner using a fluid fuel, where the blower with attached motor is disposed on one side of a blower casing and where the fire tube is disposed on the other side of the blower casing.

2. Brief Description of the Background of the Invention Including Prior Art

Burners of the type recited above are known for the fuels gas and oil. They are provided with a fire tube. A fuel nozzle is disposed inside of the fire tube, which feeds the fuel centrally to the fire tube. An annular air supply channel is disposed between the fire tube and the nozzle. The annular supply channel is fed by a blower. A certain length of the fire tube is unavoidable for achieving of a uniform air distribution. However, since the blower had hitherto been mounted axially on the side disposed remote from the heat exchanger, there resulted a construction length of the unit burner-blower arrived at by adding the lengths of the two component parts. In view of more modern recent smaller dimension heat exchangers, such a construction length has become unacceptable.

It is further known that the air flow, provided by a pressure blower to the interior of a fire tube of a burner, can be regulated with a prethrottle. However, such a device does not allow a pressure control of the air placed in the interior.

Furthermore, conventional burners have the fire tube in a horizontal position. Since the fluid outflow end of the fire tube is provided with a conical metal taper, there exists the possibility that oil, dropping off after extinction of the flame, passes to the outer jacket of the fire tube and runs along the inclination of the cone. In this case, the oil moves in the direction of the air and fuel supply side of the fire tube, which can result in soiling and dirt accumulation at the outer parts of the burner. Furthermore, conventional burners are frequently quite noisy.

Conventional burners, which are preferably employed as oil burners, but which can also be gas burners, are associated with the difficulty of inspecting the inner space of the fire tube for servicing purposes. The access to the inner space of the fire tube is impeded because the front side end of the fire tube is covered by the baffle plate and the rear end of the fire tube is provided with a back wall, which provides feed-throughs for a plurality of lines.

SUMMARY OF THE INVENTION

1. Purposes of the Invention

It is an object of the invention to provide a fuel burner which is a compact unit comprising burner and blower, where the construction length is substantially reduced in comparison with conventional burners.

It is another object of the present invention to provide a pressure controller for the supplying of air to a blower burner, such that control of the relative amounts of fuel supply and air supply at the burner becomes possible.

It is a further object of the present invention to prevent the passing of oil, dropping off after extinction of the flame, into the outer jacket of the fire tube.

It is yet another object of the present invention to reduce the noise level of such a burner without changing the construction situation of the coordination of burner relative to the casing of the heat source.

It is an additional object of the present invention to control the precise amount of air fed to the burner and to exclude leakage substantial amounts of air to be supplied.

It is a yet further object of the invention to provide a blower burner, where the fire tube is relatively easily accessible for inspection purposes.

These and other objects and advantages of the present invention will become evident from the description which follows.

2. Brief Description of the Invention

The present invention provides a blower burner for a heat source. A blower is mounted in a blower casing and a drive motor is attached to the blower. A fire tube is disposed adjacent to the outer circumference of the blower. The front of the fire tube protrudes on the flame side of the blower burner and the rear side of the fire tube protrudes rearwardly beyond the rear opening of the blower casing. A means is provided for covering the rear opening of the blower casing into which the rear side of the fire tube protrudes.

The drive motor can protrude to the rear of the blower casing or, alternatively, be disposed at the center of the blower. The axis of the blower and the axis of the burner can be disposed and shifted in parallel direction relative to each other. The cover can be cup-shaped. A sleeve can be supported at the inside of the cover and can slide over the outside jacket of the fire tube. The fire tube can be provided with openings at its rear end, which openings can be covered by the sleeve. A servomotor can be disposed at the rear side of the cover for adjusting the position of the sleeve relative to the openings.

There is further provided a method of heating a boiler which comprises collecting the air to be supplied to the burner at a side of the burner, where a blower is located. Said blower blows and feeds the air to the burner. The longitudinal extension of the blower is less than the length of the fire tube.

According to another aspect of the invention a blower burner is provided with a fire tube mounted to a blower casing, a blower mounted to the casing, and a pressure controller. The measurement input values are derived from the air pressure inside of the fire tube. The output of the pressure controller provides set point adjustment values for the blower speed.

A pressure measurement joint can be disposed at the fire tube and a transducer can be connected to the pressure measurement joint and to the pressure controller. The pressure controller, the fire tube, and the blower can be integrated into a single unit. The measurement values employed can be the differences of the air pressures between the inner space of the fire tube and the atmosphere or, respectively, of the air pressures between the fire tube and the exhaust pipe. The pressure controller is preferably provided with a measurement sensor for the difference pressure.

Another method of burning fluid fuel for heating a heat exchanger includes the following steps: The air pressure in the inner chamber of the burner is measured. The measured signal is processed in a controller. The controller determines the speed of the blower. The blower is controlled with a signal from the controller. This controls and adjusts the air/fuel ratio. A feed line runs into a nozzle disposed in the fire tube. A blower provides air to the fire tube having a baffle disk at its front side.

According to a further aspect, an oil blower burner is provided for a heat source which comprises a blower disposed on one side of a blower casing. A drive motor is attached to the blower and protrudes beyond the rear wall of the casing. A fire tube is disposed on the other side of the casing relative to the blower and at an angle. The front output end of the fire tube is disposed at a lower level as compared to the input side end. The rear wall of the fire tube protrudes the rear wall of the blower casing. Said wall is directed to the motor. The rear wall of the fire tube protrudes into a cover attachment of the blower casing.

A conical taper can be provided at the fire tube, where the transition point between the conical taper and the fire tube is the lowest point of the fire tube.

There is further provided a method comprising moving the fuel and the air combustion mixture downward through the fire tube at an angle and supplying the air collected on a side of the fire tube with a blower. According to another aspect a blower burner for a heat source comprises a sound absorber disposed between a blower burner and a blower casing. The sound absorber can comprise a sheet metal casing. The inner wall can be covered with a sound absorbing material and be provided with at least one deflection baffle. The sound absorber can be provided as a shell-like recessed sheet metal part, which attaches with the open side to a front side of the casing of the blower. The sound absorber is preferably provided with two input openings disposed on opposite sides, which are connected to the air input suction opening of the blower via a deflection baffle. The deflection baffle is provided by the end of a tongue and by a side of the sound absorber. The sound absorber can comprise in its interior at least two deflection baffles effective for deflecting sound waves and disposed relative to two planes vertical to each other. The sound absorber can comprise a casing formed as a rectangular parallelepiped. An inlet opening is provided at a narrow side and an outlet opening is provided at a wide side.

There is further provided a method which comprises absorbing sound in a blower burner with sound absorbing materials disposed on surfaces inside the blower burner and/or on baffles placed inside the blower casing, which additionally deflect the sound.

According to a further aspect of the invention, a blower burner for a heat source comprises a sleeve subdivided in axial direction and provided with a tensioning provision. A fire tube is provided with a jacket and with openings, which can be covered more or less with the sleeve. An internal fuel feed is furnished for supplying a nozzle in a fire tube. An outer air feed is provided via the jacket of the fire tube.

The sleeve is preferably disposed at the outer jacket of the fire tube. The tensioning provision is provided as a tension spring. The sleeve can rest at the inside of the fire tube and the tensioning provision can be provided as a tension spring. The sleeve can be comprised of two parts, between which two partial joints are disposed, and where, in each case, two tensioning provisions are provided. Two partial joints can be provided between the two parts of the sleeve and these partial joints are covered with covering elements. The tensioning provision can be attached to the covering elements. The covering elements can be solidly connected with a part of the sleeve and can be provided with a protrusion, to which the tensioning provision, furnished as a tension spring, is attached such that, in each case, the other part of the sleeve supports directly a protrusion to which the other end of the tension spring is attached. The sleeve can be provided with only a single partial joint and where the sleeve itself is springlike.

Another method provides for an adjusting of the position of a sleeve relative a fire tube. The fire tube is provided with air inlet openings for adjusting the area of the openings available for passage of air into the fire tube and spring-tensioning the sleeve subdivided into two parts with springs.

According to a further aspect of the invention a blower burner is provided which comprises a cover part forming part of a casing and provided with a recess. A fire tube is radially subdivided and is attached with its back side to a part of the blower casing. A front part of the fire tube can be removed. Thus a method for inspection of a fire tube is provided by removing the front part of the fire tube in a burner. The fire tube is disposed about parallel and adjacent to an air supply blower.

A bearing support can be provided for the front part of the fire tube, which is formed immediately on the rear part of the fire tube.

There is also provided a blower burner which comprises a cover part forming part of a casing and provided with a recess. A fire tube is supported at its back side at the inner side of the cover part of the casing. A flange is attached to the outer part of the cover part supporting the fuel supply line, the nozzle, the ignition electrode and the baffle disk. Attachment elements can be provided for the fire tube. The flange is preferably provided as a planar cover plate, which covers the attachment elements of the fire tube. The flange can support feed-throughs for all elements protruding into the fire tube.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

In the accompanying drawings, in which are shown several of the various possible embodiments of the present invention.

DESCRIPTION OF INVENTION AND PREFERRED EMBODIMENT

Figure 1:
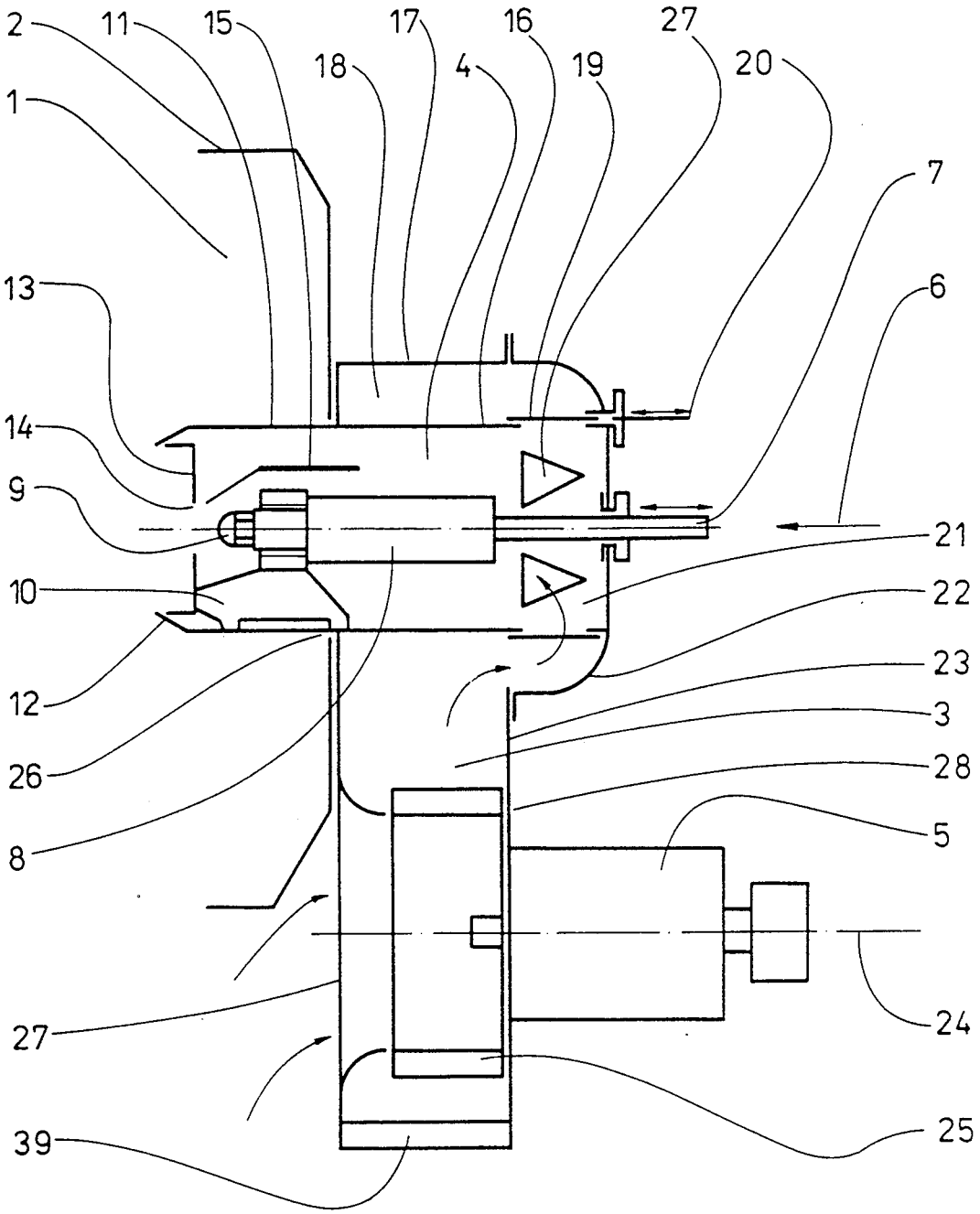
FIG. 1 is a schematic sectional view of a blower burner according to an embodiment of the invention.

In accordance with the present invention there is provided a blower burner for a heat source with a blower casing, where the blower with attached motor is received on one side and where the fire tube of the burner is located on the other side. The drive motor and the fire tube form protruding parts on opposite sides of the blower casing. The rear side 16 of the fire tube 11 protrudes beyond the rear side 28 of the blower casing disposed toward the drive motor. The rear side 16 of the fire tube 11 protrudes into a cover attachment 22 of the blower casing. The axis 6 of the fire tube and the axis 24 of the blower 5 are preferably disposed about parallel to each other and at a distance from each other. The cover 22 can be formed as a cup, and a sleeve 19, sliding on the outside jacket of the fire tube 11, can be supported at the interior of the sleeve 19. The fire tube 11 can be provided with openings 27 at its rear end 16, which can be covered by the sleeve 19. A servomotor 20 for adjusting the position of the sleeve 19 can be supported at the rear side of the cover.

A compact unit 3 comprising a burner 4 and a blower 5 is flanged to a case 2 of a heat source 1 according to FIG. 1 near an opening 26, which comprises a heat exchanger not shown. The burner 4 protruding into the heat source 1 comprises in its interior a feed supply line 7 in the form of a pipe, which runs concentrically to the symmetry axis 6 of the burner. The pipe is connected to a gas line or to an oil pump not shown here. In case of an oil burner, an oil preheater 8 is disposed in the course of the pipe line 7. The pipe line 7 ends with a fuel nozzle 9 at its end disposed toward the heat source 1. The nozzle or alternatively, the preheater and the pipe, are supported via three web sheets 10, uniformly distributed over the circumference at the inner jacket of the fire tube 11, which protrudes deeply into the case 2 of the heat source 1. The fire tube is mounted concentrically to the axis 6 and is formed as a cylinder component like the pipe, the preheater 8, and the nozzle 9. A baffle disk 13 is disposed at the end 12 of the fire tube located close to the heat generation point, and the baffle disk 13 is provided with a central opening 14. An ignition electrode 15 is directed to the space between the central opening 14 and the nozzle 9. The rear end 16 of the fire tube 11, remote from the heat generation point, is surrounded by a casing 17, which is part of the construction unit 3. A cylindrical annular space 18 is formed between the casing 17 and the outer jacket of the fire tube 11, and sleeve 19, as an extension of the fire tube 11, can be shifted in the direction of the axis 6 on the fire tube 11. The fire tube 11 is provided with openings 27 at its rear end 16, which openings 27 are radially distributed over the jacket. It is possible by shifting of the sleeve, covering more or less the openings 27, with a servomoter 20 schematically indicated, to free a larger or smaller passage cross-section from the annular space 18 into the interior space 21 between the tube and the inner jacket of the fire tube 11.

The outer jacket of the casing 17 contains a casing 23 of the blower 5, the center axis 24 of which is disposed in parallel and at a distance relative to the axis 6. The casing is a radial casing with a fan wheel 25, the axis of which is aligned in a similar way to the axis 24. A sound absorber 39 is disposed between the fan wheel 25 and the blower casing 17.

The casing 17 is covered with a casing cover 22 on the side remote from the heat source 1. The casing cover 22 is provided recessed like a cup. The inner jacket of the cup is directed here both to the annular space 18 as well as to the interior space 21. The sleeve 19 is supported in this interior space of the cover and the servomoter 20 for the sleeve is also attached here. The sleeve thus receives correspondingly both a part of the cylindrical annular space 18 as well as part of the center inner space cf the fire tube 11.

A axial blower fan can also be selected instead of the radial blower according to the embodiment of FIG. 1. In this case the axis 24 of the motor and respectively also the then employed roller would be placed parallel to the axis 6 and at a distance from it.

The air from the casing 23 of the blower 5 is fed initially into the recessed cover based on the arrangement of the recessed cover, which shows an inner radius considerably larger than the outer radius of the fire tube 11. The combustion air then passes into the interior of the fire tube, which is provided of a sufficient length based on this construction. A part of the uniformity of the air vortex in fact occurs in the interior spaces of the recessed covers, such that the length of the fire tube is sufficient for the uniformization of the air supply.

Thus, the longitudinal or, respectively, axial extensions of the burner or, respectively, of the blower are on top of each other or next to each other, depending on the mounting in the path of the longitudinal extension in the direction of the axes 6 and 24. The total lengths of the two components are no longer defined by the lengths of the two individual components, but instead by the length of a single one of the components plus a slight addition. The unit blower-burner is thus considerably flatter than this could have been achieved up to now according to the state of the art.

The component 3 has approximately the shape of a cuboid or of a rectangular parallelepiped and its interior serves as an air path for the blower. The construction unit is provided with two large oppositely disposed sides, of which the side 27 provides the front side, which is disposed toward the casing 2 of the heat source. The rear side 28 of the casing is that side where the cover 22 is attached and where the motor of the blower 5 is disposed. The cover 22 and the blower 5 with drive motor protrude beyond the rear side 28, while the front end of the fire tube protrudes to the front side 27, which fire tube protrudes into the casing 2 of the thermal source 1.

According to a second embodiment, a blower burner with a device for controlling the air/fuel ratio is provided with a feed line ending in a nozzle within the interior of the fire tube. The fire tube carries a baffle disk at its mouth. A pressure controller 126 is provided where the measurement input value is the air pressure in the interior space 132 of the fire tube 103, and the value, adjusted by the output signal of the controller, is the adjustment of the rotation speed of the blower.

The fire tube 103 can have disposed thereon a pressure measurement joint, which is connected to the pressure controller 126 via a transducer 124. An integration of the controller 126, of the fire tube 103, and of the blower 106 can be provided to a single unit. The difference of the air pressures in the inner space 132 of the fire tube and of the atmosphere or, respectively, the pressure difference of the fire chamber and the exhaust gas channel, can be provided as a measurement parameter. The pressure controller 126 can be provided with a measurement sensor 130 for the difference pressure.

Figure 2:
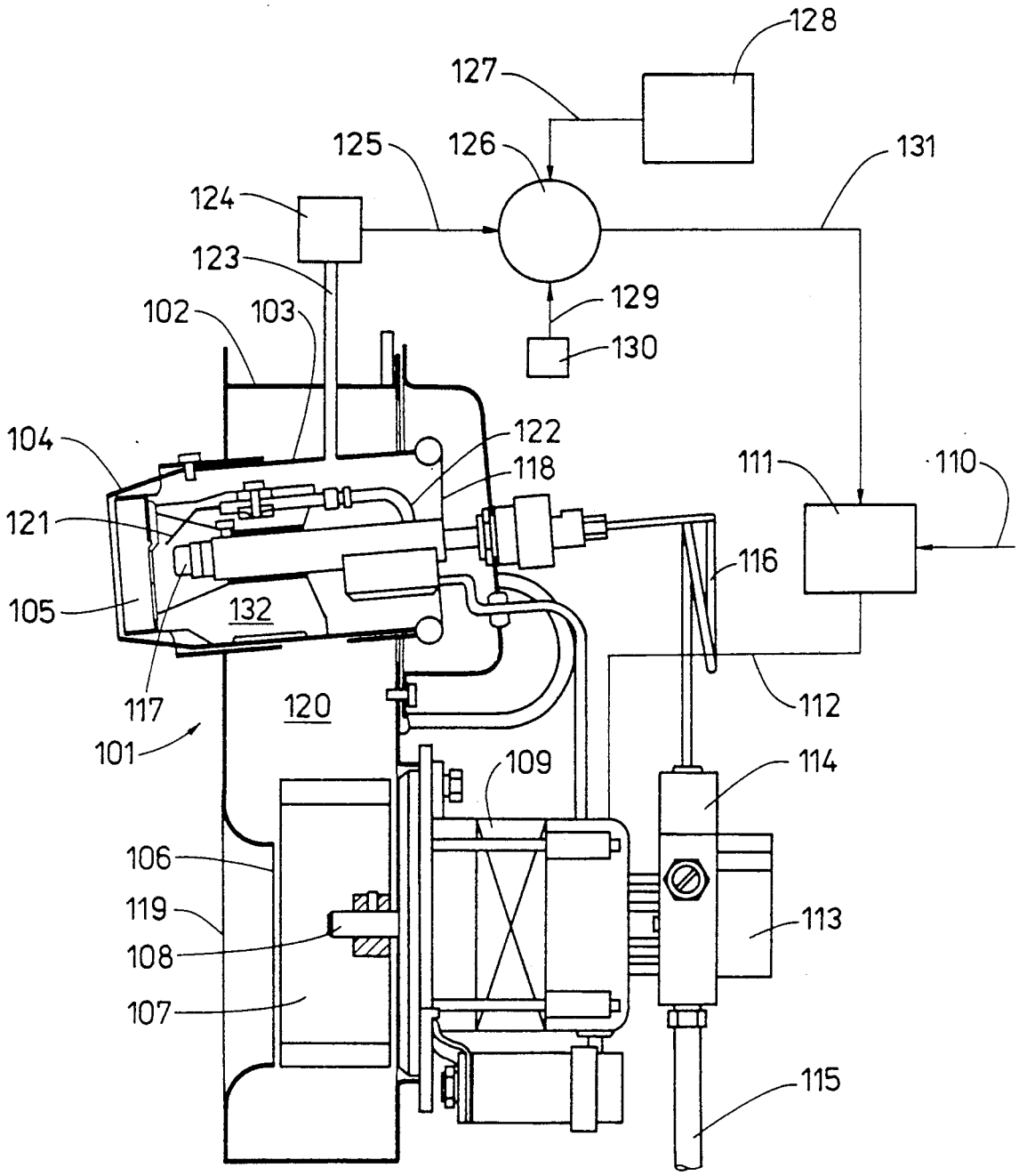
FIG. 2 is a schematic sectional view of another blower burner according to the invention.

FIG. 2 of the drawing shows, in principle, an oil burner in a cross-sectional representation, although the invention can be applied to any blower burner independent of the use of a liquid or gaseous fuel The oil burner 101 is substantially comprised of a fire tube 103 disposed inclined in a casing 102. The mouth 104 of the fire tube 103 is provided with a baffle disk 105. In addition, a blower 106 is placed in the casing 102 and the blower is provided with a blower wheel 107, which is attached to a servoshaft 108, which is actuated by an electromotor 109. The motor is connected to a grid 110, not shown in detail, via a speed control provision 111, which is connected to the motor via an active line 112.

An oil pump 113 is disposed on the shaft 108 of the motor 109. The casing 114 of the oil pump 113 is fed by a fuel supply line 115. The pressure port of the fuel supply line is connected via an oil feed line 116 to an oil nozzle 117 disposed in the interior of the fire tube.

The fire tube 103 is open at its input-side end 118 disposed inside of the casing 102. An input port 119 in the casing is connected to the open end 118 via the blower wheel and via an air channel 120.

An ignition electrode 121 is disposed in the interior of the fire tube in the annular space between the oil nozzle, respectively, the line 116 and the inner jacket of the fire tube. Said ignition electrode is connected via a line 122 with a supervising and ignition means.

A pressure measurement port 123, formed as a tube running nearly perpendicular to the jacket, is connected to the jacket of the fire tube 103 and is led to a transducer 124. Said transducer in turn is connected via a measurement signal line 125 to a pressure controller 126. A set point adjuster 128 is connected via a line 127, and an atmospheric pressure reference signal provider 130 is connected via a line 129 to the pressure controller.

An adjustment line 131 runs from the pressure controller to the rotation speed adjustment setting provision 111.

The actual value transmitter 130 for the atmospheric pressure can be disposed in the fire chamber space, into which the flame enters via the mouth 104. Alternatively, the actual value transmitter 130 can also be disposed in the mounting area of the boiler or at another area. The set point adjuster 128 can be adjusted either manually or can be coordinated to a heat controller such that, after determination of a certain heating power, a definite set value results as a set point both for the fuel flow as well as for the air flow and thus for the air pressure.

The pressure controller operates as follows:

During regular operation, the air pressure prevailing in the interior space 132 of the fire tube 103, which is maintained by the blower 106, is read via the measurement port 123 and is transformed in the measurement transducer 124 into a preferably electrical signal and is provided to the pressure controller via line 125. This actual value signal is subtracted from the atmospheric pressure determined by the actual value transmitter 130 which, similarly, is connected to the controller via the line 129.

This difference signal is compared with the set point signal coming from the set point adjuster 128 and, based on the deviation from the set point, there is changed via the line 131 and the rotation speed adjustment provision 111 the voltage supply from the grid 110 for the motor 109 via line 112 such that the deviation from the set point is reduced. Here the controller can be a proportional controller or an integral or, respectively, a PI controller.

For example, if this pressure controller is employed for a hot-water heating system, which in general is provided via an outside-temperature-dependent output feed line control, then the set point for the power output of the burner is provided by the outside temperature signal. A signal for a certain fuel flow is taken off from this set point and this results, via the drive motor 109, in a certain fuel supply power amount of the oil pump 113. At the same time, this set point also serves as a set point for the air pressure present in the inner space 132. This air pressure is maintained constant at a certain reference value by the pressure controller. The heating power is thus the command variable and the reference input for the pressure controller 126.

According to a further embodiment, the blower burner can be used for the burning of oil. The blower with attached motor can be located on one side of the blower burner and the fire tube of the burner can be disposed on the other side. The drive motor and the fire tube can form protruding parts on opposite sides of the blower casing. The rear side of the fire tube can protrude beyond the rear side of the blower casing toward the drive motor. The rear side of the fire tube can protrude into a cover attachment of the blower casing. The fire tube 211 can be disposed at an angle, and the end 212 on the outflow side of the fire tube can be at a lower level as compared to the inflow end. The outflow end 212 of the fire tube 211 can be provided with a conical taper, and the transition point between the conical section and the cylindrical fire tube can form the lowest level of the fire tube.

Figure 3:
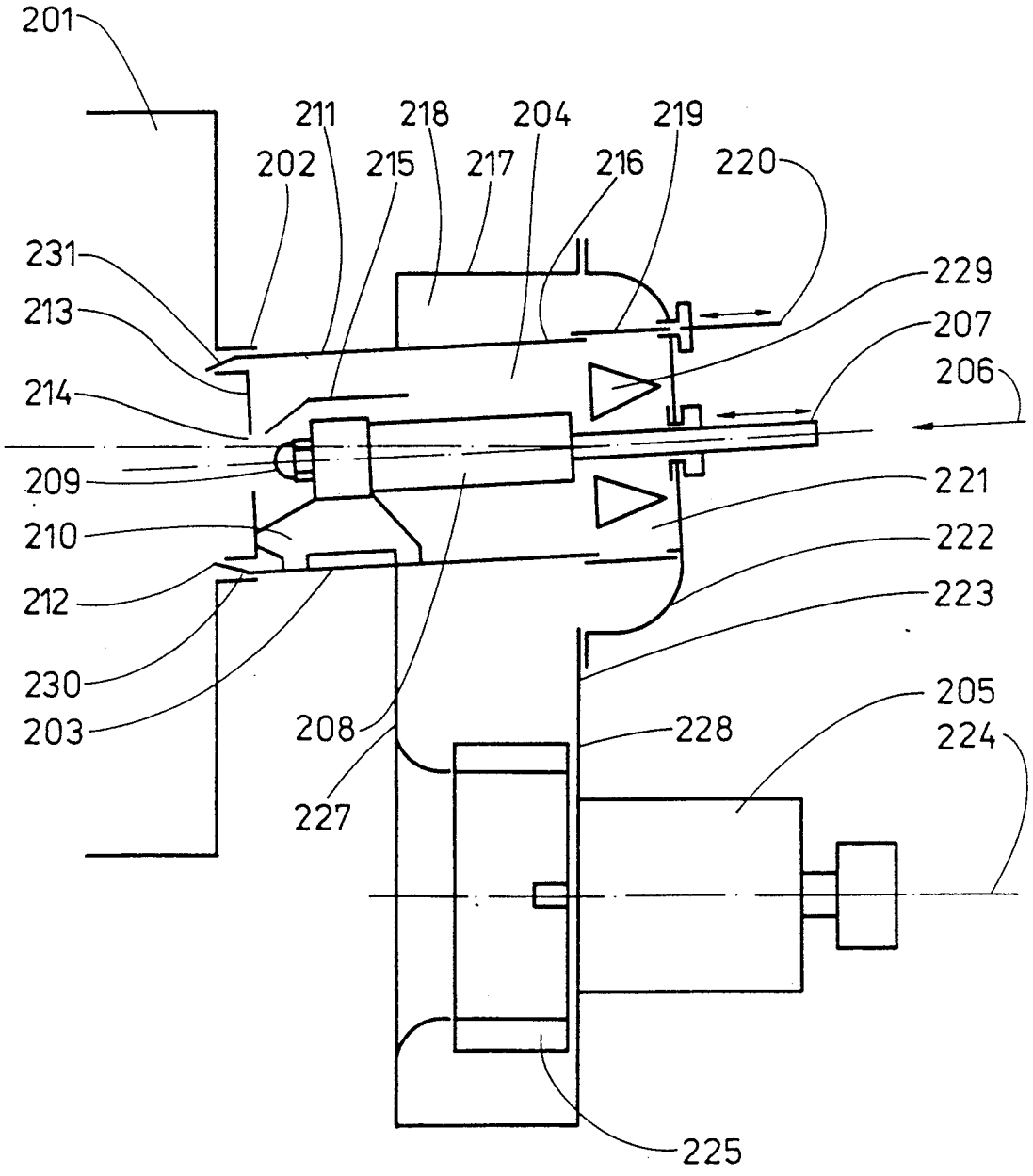
FIG. 3 is a schematic sectional view of a further blower burner according to the invention.

A compact unit 203, comprising a burner 204 and a blower 205, is flanged to the casing 201 of a heat source, which is provided with a heat exchanger, not shown here, via an opening 202. The burner 204, protruding into the heat source, comprises in its interior a fuel feed line 207, formed as a pipe and disposed concentrically to its symmetry axis 206. The fuel feed line 207 is connected to an oil pump, not shown in FIG. 3. An oil preheater 208 is disposed in the line of a pipe line 207. The pipe line 207 ends at its end, disposed toward the heat source, with a fuel nozzle 209. The nozzle and, respectively, the preheater and the pipe are supported by four web support sheets 210 uniformly distributed over the circumference at the inner jacket of the fire tube 211. Said fire tube 211 protrudes deeply into the casing 201 of the heat source. The fire tube is constructed concentrically to the axis 206 and is a cylinder component just as the tube, the preheater 208 and the nozzle 209. A baffle disk 213 is disposed at the end 212 of the fire tube facing the heat source, and the baffle disk is provided with a center opening 214. An ignition electrode 215 is directed into the space between the opening 214 and the nozzle 209. The fire tube is surrounded on its rear side end 216, directed away from the heat source, by a casing 217. Said casing is part of the construction unit component 203. The fire tube is supported in the casing at an inclined angle of 3 degrees, such that the lowest point 230 of the fire tube rests at point where the fire tube tapers into a conical section 231 at its end directed toward the heat source. The fire tube can be inclined at angles of from about 1 to 5 degrees and it is preferably inclined at an angle of from about 2 to 4 degrees. An annular cylindrical intermediate space 218 is formed between the casing 217 and the outer jacket of the fire tube end 216. A sleeve 219 is slidably supported on the fire tube as an extension of the fire tube 211 in the direction of the axis 206 in the annular cylindrical intermediate space 218. The rear side end 216 of the fire tube 211 is provided with openings 227 which are radially distributed over the jacket. By shifting of the sleeve, more or less covering the openings 229, driven by a servomotor 220, schematically indicated, it is possible to free a larger or smaller flow cross-section from the annular space 218 into the inner space 221 between the tube and the inner jacket of the fire tube.

A casing 223, which can have a planar projection of a spiral, of the blower 205 is contained in the outer jacket of the casing 217. The center axis 224 of the blower 205 can be inclined by 3 degrees and be disposed at a distance to the axis 206. The blower is a radial blower with a fan wheel 225, the axis of which is practically aligned with the axis 224.

The casing 217 is covered on its side 228 remote from the heat source with a casing cover 222 disposed at an inclined angle of 3 degrees. The inclination angle of the casing cover can be from about 1 to 5 degrees and is preferably from about 2 to 4 degrees. The casing cover is provided with a cup shape. In this case, the inner wall of the cup is disposed toward both the annular space 218 as well as the inner space 221. The sleeve 219 is supported in the cup cover inner space. The servomotor 220 for the sleeve is also attached at the cover. Therefore, the sleeve receives a part of the ring intermediate space 218 as well as a part of the center inner space of the fire tube 211.

The inclined support position of the fire tube in the casing 217 provides that the inflow end of the fire tube is located at a higher level as compared to the outflow end. It becomes thereby impossible for the dripping-off oil, even after extinguishing of the flame, to move upwardly in the direction of the casing 217 and to soil and contaminate the outside of the casing 217 or the casing itself.

A sound-proofing provision 314 can be disposed between the casing 301 and the blower burner 307 or the burner casing 306. The sound proofing provision can comprise a sheet metal case, the inner wall of which is covered with a sound absorbing material and which is provided with at least one sound deflection baffle. Preferably, at least two effective deflection baffles are disposed in the air space 326 inside of the sound absorber 314. The case of the sound absorber can be provided as a rectangular cuboid. The input opening 325 can be disposed at a narrow side 322, and the outlet opening 315 can be provided at a wide side 323. The sound absorber can be formed as a shell-like recessed sheet metal part, which rests with its open side at the side 313 of the casing 309. The sound absorber 314 can be provided with two inlet openings 336 disposed on opposite sides, which are in connection with the air-suction opening 311 of the blower 309 via, in each case, a deflection means, which is formed by the end of a tongue 327, and one side 334, 335 of the sound absorber.

Figure 4:
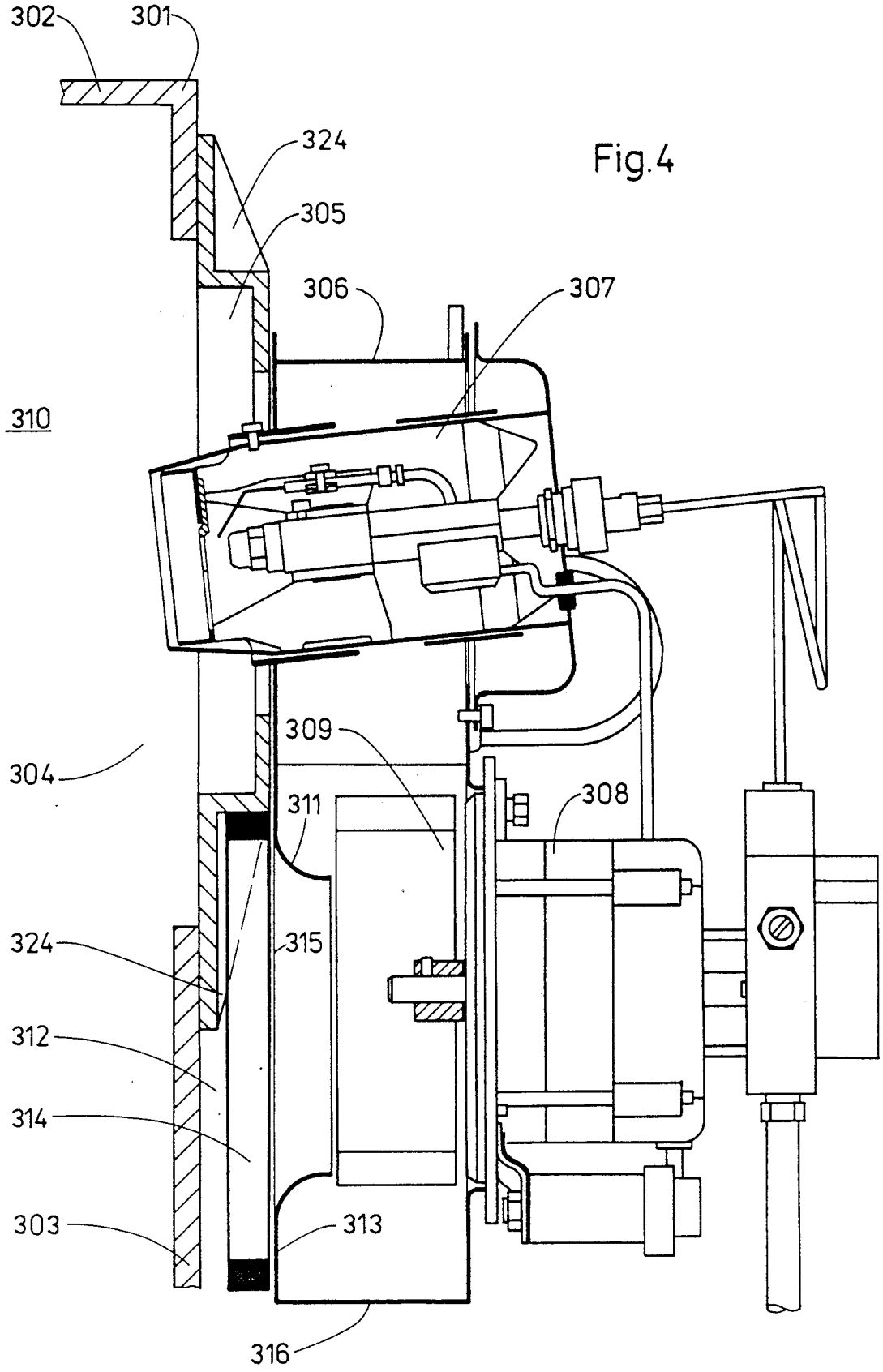
FIG. 4 is a schematic sectional view of an additional blower burner according to the invention illustrating damping provisions.

A casing 301, as illustrated in FIG. 4, for a fuel-fired heating apparatus, such as an oil fired boiler, can have a rectangular parallelepipedal form. Said casing comprises an upper side 302 and a side wall 303, which contains an opening 304. Said opening can be covered by a burner door 305. The burner, in turn, is provided with a casing 306, which contains the oil burner proper 307, formed as a fire tube, and a blower 309 driven by a motor 308. The fire tube protrudes through the opening 304 into the inner space 310 of the boiler and is placed slightly at an angle. The burner case 306 is provided with an air suction feed opening 311, which is directed into an intermediate space 312 between the front side 303 and the front side 313 of the casing 306.

Figure 5:
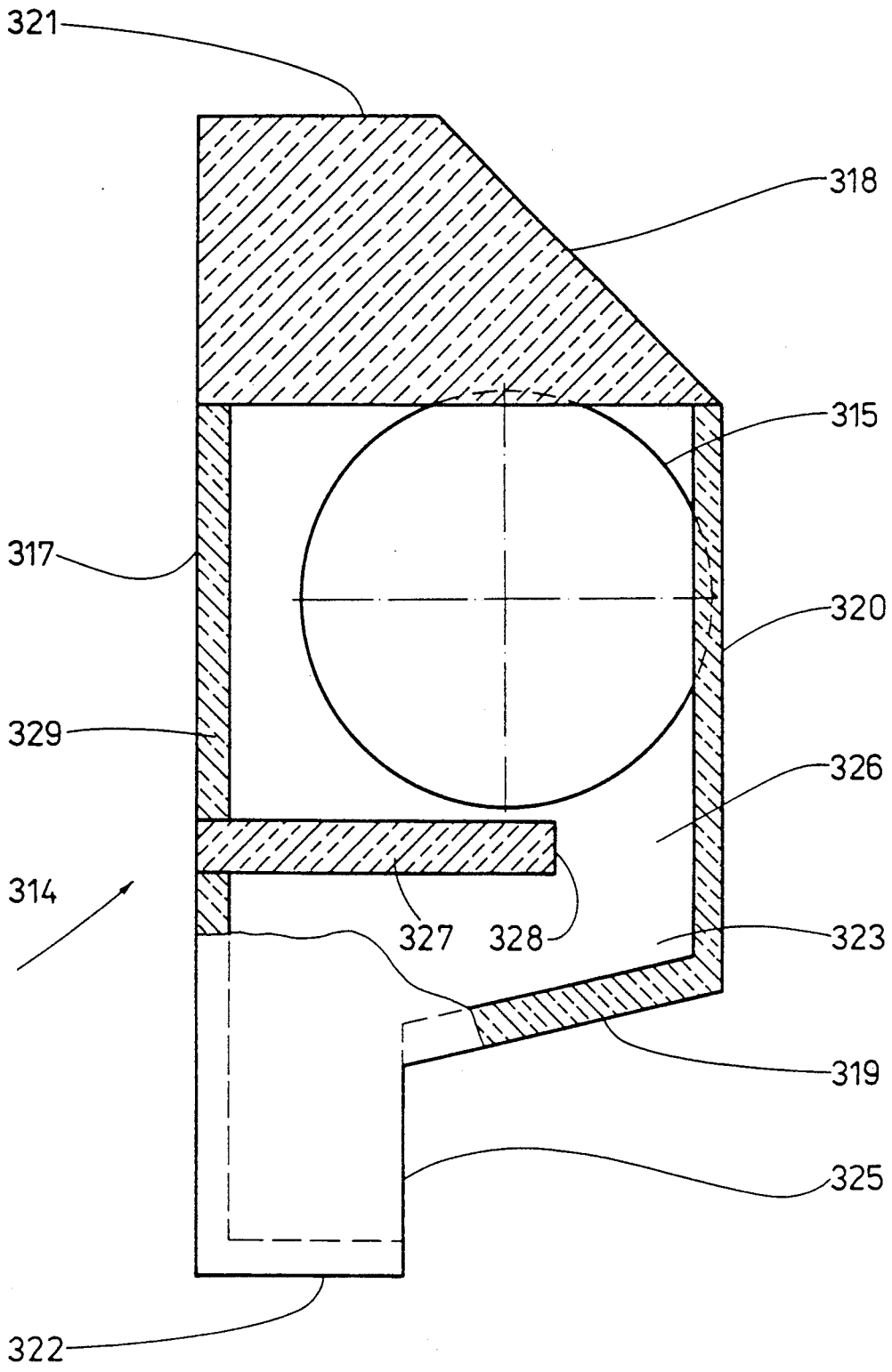
FIG. 5 is a schematic sectional view of a damping provisions of a burner.

It is not that simple to provide an inlet suction sound absorber based on these dimensions of the intermediate space 312 between the two casing front walls 303 and 313. Nevertheless, the invention provides a sound absorber 314 located in this intermediate area 312. The sound absorber is disposed at the front side 313 of the burner casing 306 such that it covers the inlet suction opening 311 with its output opening 315. The suction inlet opening 311 is displaced by 180 degrees relative to the bottom side 316 of the burner casing 306 and is disposed there, where the intermediate space passes unimpeded into the atmosphere. Alternatively, the suction inlet opening can also be disposed at the side. The sound absorber is constructed from sheet metal and has about the shape of a hollow cuboid, as can be recognized from FIG. 5. This hollow cuboid is provided with a first narrow face 317 and a further oppositely disposed narrow face 320 with bevelled sides 318 and 319. The narrow sides are connected to each other via the front faces 321 and 322. The narrow faces and the front faces are connected to each other via wide faces 323, of which only the wide face disposed in the front can be recognized in FIG. 5. The wide faces 323 rest in one instance at the front side 313 of the burner casing 306 or, respectively, are directed toward the front face 303 of the heating appliance casing 301. The bevelled sides 318 and 319 are furnished in order to leave room for ribs 324 in the area of the burner door.

The outlet opening 315 is disposed on one wide face. The inlet opening is provided at the upper side 325 or, respectively, at the narrow side 321 or 322. The input and output openings of the sound absorber are connected to each other via several deflections, which are disposed in the interior 326 of the sound absorber. Said deflections can be located at different levels. For example, a tongue 327 is disposed in the inner space 326 such that, from the inlet opening 325, there results initially a deflection of about 150 degrees in the plane of the drawing for the sucked-in stream of air, which is followed by a deflection in the same plane around the tip 328 of the tongue. Subsequently, a deflection occurs in the direction of the outlet opening 315, which is located perpendicular to the drawing plane. Nearly the total inner wall of the casing of the sound absorber 314 is covered with a sound absorbing material 329. The tongue 327 also comprises this material. A direct sound emission, without several reflections at the inner walls of the casing, is not possible as referred to the output opening 315 relative to the input opening 325. The released sound energy coming from these reflections and which can exit at the inlet opening 325 is substantially reduced in its power level. Both the inner sides of the narrow sides as well as the inclinations and the inner faces of the front faces are covered with sound absorbing material.

Only the input and the output openings are free of sound absorbing material. An optimum use of the available space as well as a surprisingly good minimization of the sound emission is made possible by the incorporation of the sound absorber in the intermediate space present between the burner casing 306 and the casing 301 of the fuel-heated heating apparatus.

Figure 6:
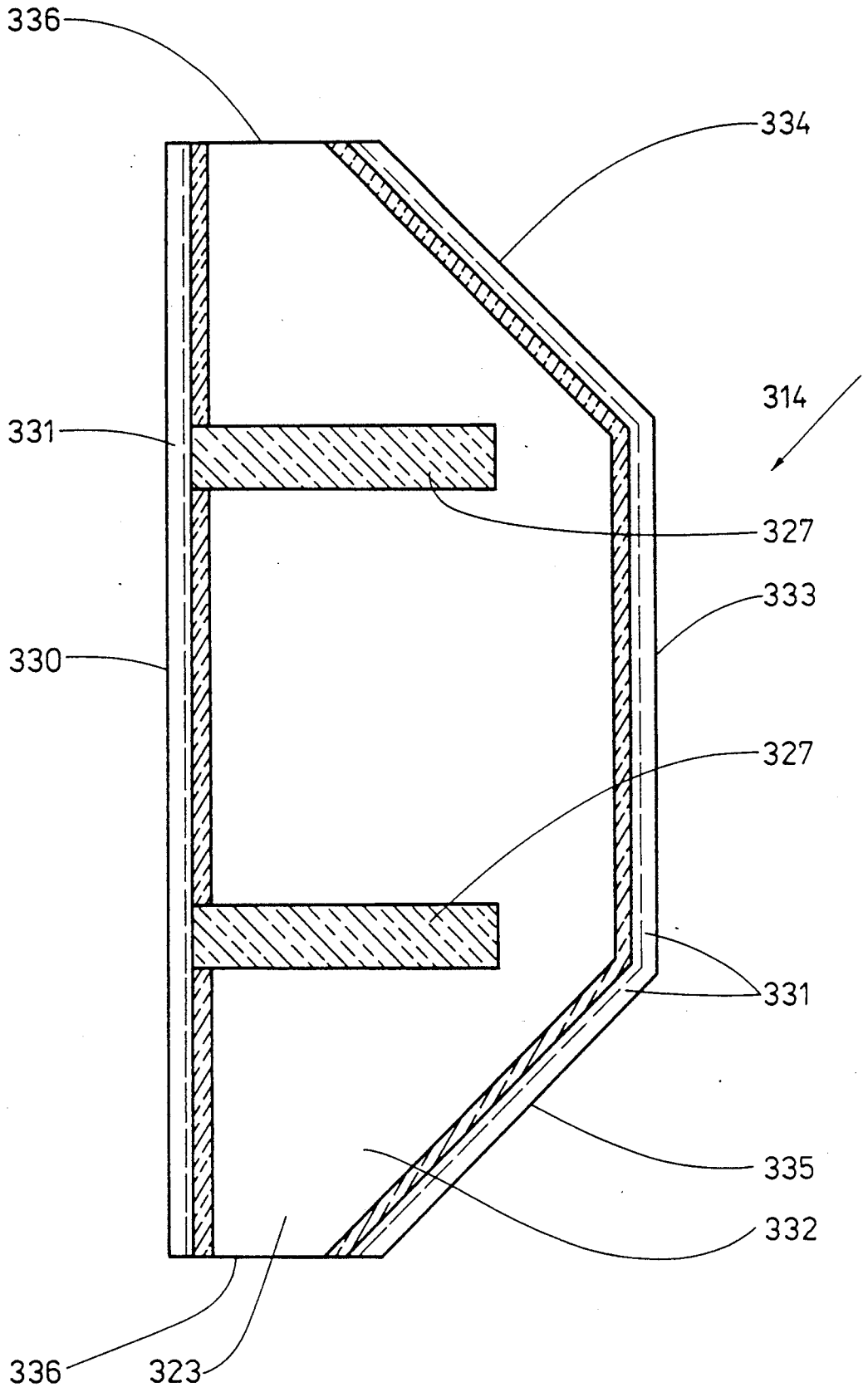
FIG. 6 is a schematic sectional view of the damping provisions of a burner with two baffle plates.

FIG. 6 shows a view of the burner on the boiler according to another feature of the invention. The sound absorber comprises a shell-like bent sheet metal part. Said sheet metal part is provided with a wide side 323, which is of about trapezoidal shape with cut off corners at the base face. The base face 330 can be provided with a bending 331 or protruding face 327, which is directed toward the interior space. The roof side 333, disposed oppositely to the base side 330, and the following inclined sides 334 and 335 also exhibit a bending 331, which is also directed to the inner space 332. The inner space is thus closed with the exception of the cut-off corners 336 of the trapezoid at the wide side and at the sides forming the circumference. It is open to the side of the observer. The sound absorber 314 is attached with its open side to the near side of the blower 309. The flanged bead is provided for sealing purposes. Two tongue plates 327 are disposed in the interior 332 of the sound absorber, and the air suction inlet opening 311 of the blower 309 is disposed between the tongues. Thus, an air access possibility exists into this air suction inlet opening 311 from the cut-off corners 336 via the intermediate space between the respective tongue plate 327 and the inclined surface 334 around the tongue plate to the air suction opening.

According to the construction described, the sleeve is guided by the outer jacket of the fire tube. The inner diameter of the sleeve exhibits a more or less large tolerance or, alternatively, unroundedness. The same holds true of the size of the outer jacket of the fire tube and its rounding tolerances which, correspondingly, can be both added or also compensated. Thus, it can occur that, in one case, the sleeve is movable along the fire tube only with difficulty while, in another case, there results a substantial play between sleeve and fire tube. The first possibility leads to difficult adjustment of the air inlet feed, and the second case leads to a substantial discrepancy in air amount, where the blower burner then burns with an air excess which is too large.

According to further features, the blower burner comprises a fire tube, which is associated with an interior disposed fuel feed and with an air feed, which comes from the outside through the jacket of the fire tube. Openings are provided at the fire tube, which can be covered more or less with a shell mounted on the fire tube. The sleeve 419 is subdivided in axial direction 406 and provided with tensioning means 442, 443, 451, 452.

The sleeve 419 can rest at the outer jacket 431 of the fire tube 411 and the tensioning means can be provided as a tension spring 442, 443. The sleeve 419 can rest at the inner jacket 446 of the fire tube 411 and the tensioning means can be provided as a tension spring 451, 452. The sleeve can comprise two parts 432, 433, and two part joints 434, 435 can be disposed between the two parts and, in each case, two tensioning means 442 and 443 or alternatively 451, 452 can be provided. The part joints 434, 435 can be provided with cover elements 436, 437. The tensioning means 442, 443 can be attached to the covering 436, 437. The covering 436, 437 can be solidly connected to one part 432, 433 of the sleeve and can be provided with a protrusion 440, 441, in which the tensioning means, provided as a tension spring 442, 443, is affixed. In each case, the respective other part 432, 433 of the sleeve can carry directly a protrusion 444, 445, in which the other end of the tension spring is affixed. The sleeve 419 can be provided with a single part joint 434 and can itself be like a spring and have resilient spring properties.

Figure 7:
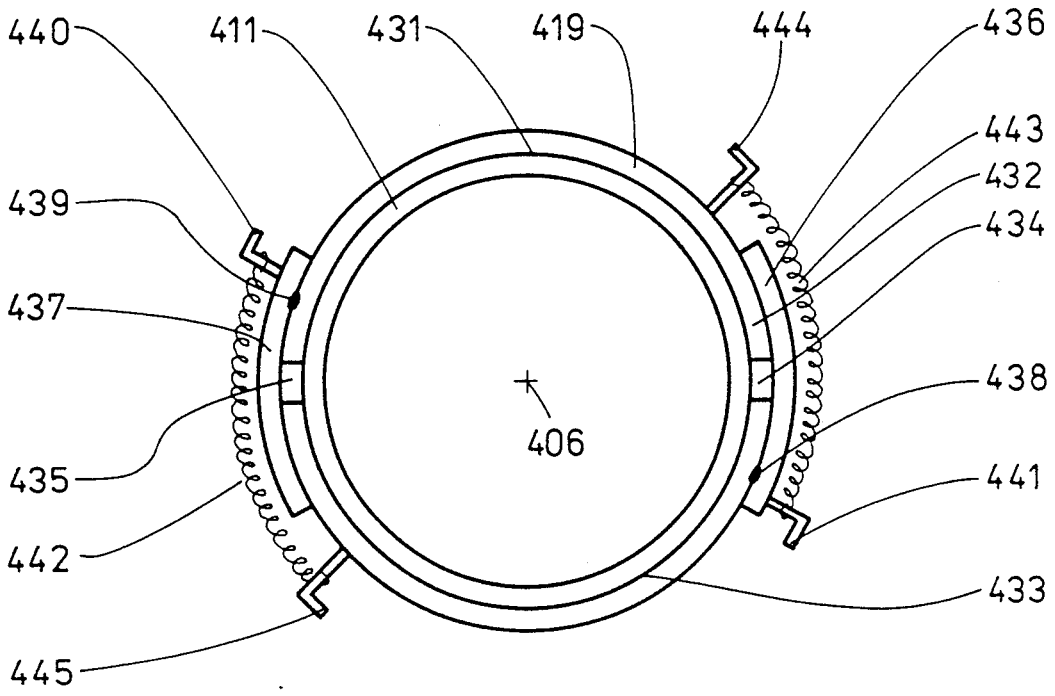
FIG. 7 is a schematic sectional view of a fire tube assembly.

A first possible form of the bearing support of the sleeve 419 on the outer jacket 431 of the fire tube 411 can be seen in FIG. 7. While the fire tube is a hollow cylinder, which is constructed concentrically to the axis 406, the sleeve 419 is subdivided into two sleeve halves 432 and 433, which form in between themselves the two part joints 434 and 435. The two part joints are covered by covering elements 436 and 437. Said covering elements are provided with a cylindrical curvature, where the curvature of the inner jacket of these covering elements corresponds to the curvature of the outside jacket of the sleeve halves. The covering 436 is connected to the sleeve half 433 via a welding seam 438, and the covering 437 is connected to the sleeve half 432 via a welding seam 439. In each case, a hook 440 and 441 is attached at the two covering elements 436 and 437 onto which is hung in each case a tension spring 442 443, respectively. The counter support for the springs is provided by a second hook 444 or, respectively, 445, which is attached to the other half 432 or 433, alternatively. The springs, of substantial tensile strength, have the task of causing the two halves 432 and 433 of sleeve to rest solidly against the outside jacket 431 of the fire tube 411, such that no slit for air leakage can be generated between the outer jacket of the fire tube and the inner jacket of the sleeve or, alternatively, the sleeve halves. Possibly still remaining leakage residues in the region of the part joints 434 and 435 cannot be redirected outwardly, since the part joints in turn are covered by the inner jacket of the covering elements 436 and 437. The spring-tensioned pressing of the sleeve halves against the outer jacket of the fire tube assures also a balancing of possible unroundedness.

Furthermore, it would be possible to provide the sleeve with only one partial joint 434 or 435 and to provide only a single covering 436 or 437 and, correspondingly, a single tension spring 442 or 443.

Figure 8:
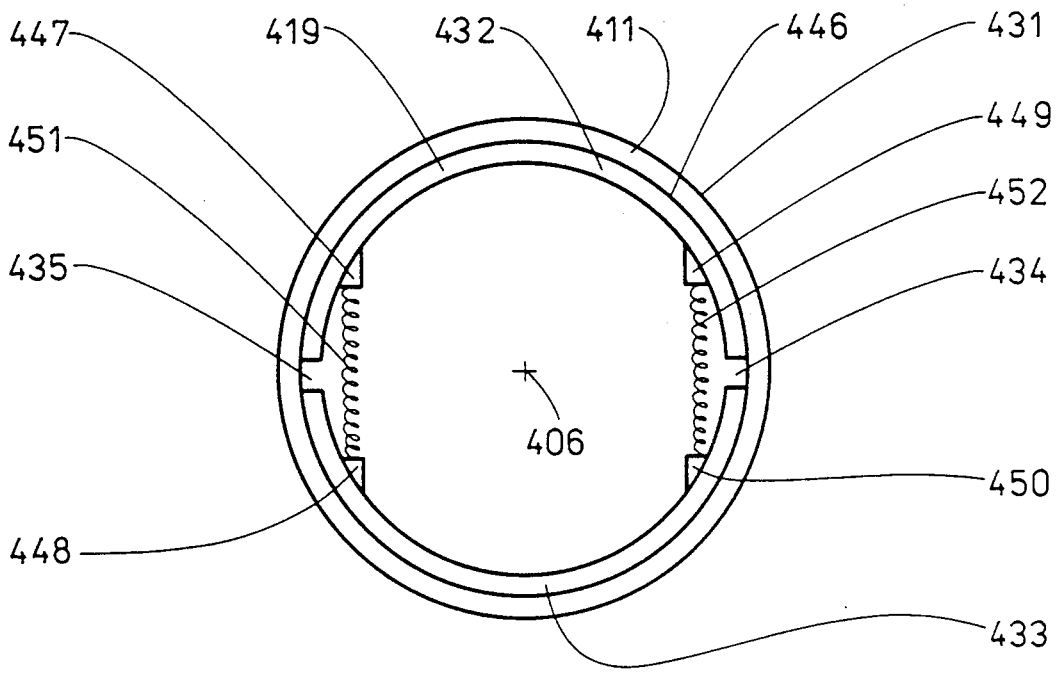
FIG. 8 is a schematic sectional view of another fire tube assembly.

The embodiment according to FIG. 8 shows the fire tube provided with recesses 427, which are covered more or less by the sleeve 419. The interiorly disposed sleeve halves 432 and 433, according to FIG. 8, are provided with protrusions 447, 448, 449 and 450 which, in each case, are disposed at the two sides of a corresponding part joint 434 435, as seen in the embodiment of FIG. 8. The protrusions 447, 448 and, alternatively, 449, 450, disposed opposite relative to a part joint 434 or 435, are tensioned by, in each case, a compression spring 451 452, respectively. The compression spring has the tendency to press the sleeve halves 432 and 433 against the inner jacket 446 of the fire tube 411. Thus, it is also possible according to these features to nearly make disappear the leakage slot between the inner jacket of the fire tube and the outer jacket of the sleeve. The advantage of this construction results in that the generated part joints 434 and 435 are covered according to their shape by the fire tube. Thus, according to this embodiment, the covering elements 436 and 437 can be dispensed with. It is also possible in the embodiment according to FIG. 8 to employ only one of the part joints 434 or 435 instead of the two part joints 434 or 435 such that the sleeve comprises a single part, and only a single compression spring 451 or 452 has to be provided for the pressing apart of the part joint.

In case of a single-part, inner or outer positioned, sleeve with a part joint it is possible to dispense with the tensioning means, since the sleeve itself is provided as a spring.

According to a further feature, the fire tube can be attached with its rear side to a part of a casing, where the fire tube 509 is radially subdivided, and where the front part 510 is removably disposed. The positioning of the front part 510 of the fire tube 509 can be formed immediately at the rear part 511 of the fire tube.

Alternatively, the rear side the fire tube can be supported at a part of the casing formed as a cover. The cover 519 can be provided with a recess 532. The fire tube can be attached to the inside of the cover and a flange 533 can be attached to the outside of the cover 519. Said flange supports the burner feed line 515, the nozzle 516, the ignition electrode 517 and the baffle disk 518. The flange 533 can be formed as a planar covering plate 521, which covers the attachment elements of the fire tube. The flange 533 can have feed-throughs for all elements 515, 517 protruding into the interior of the fire tube 509.

Figure 9:
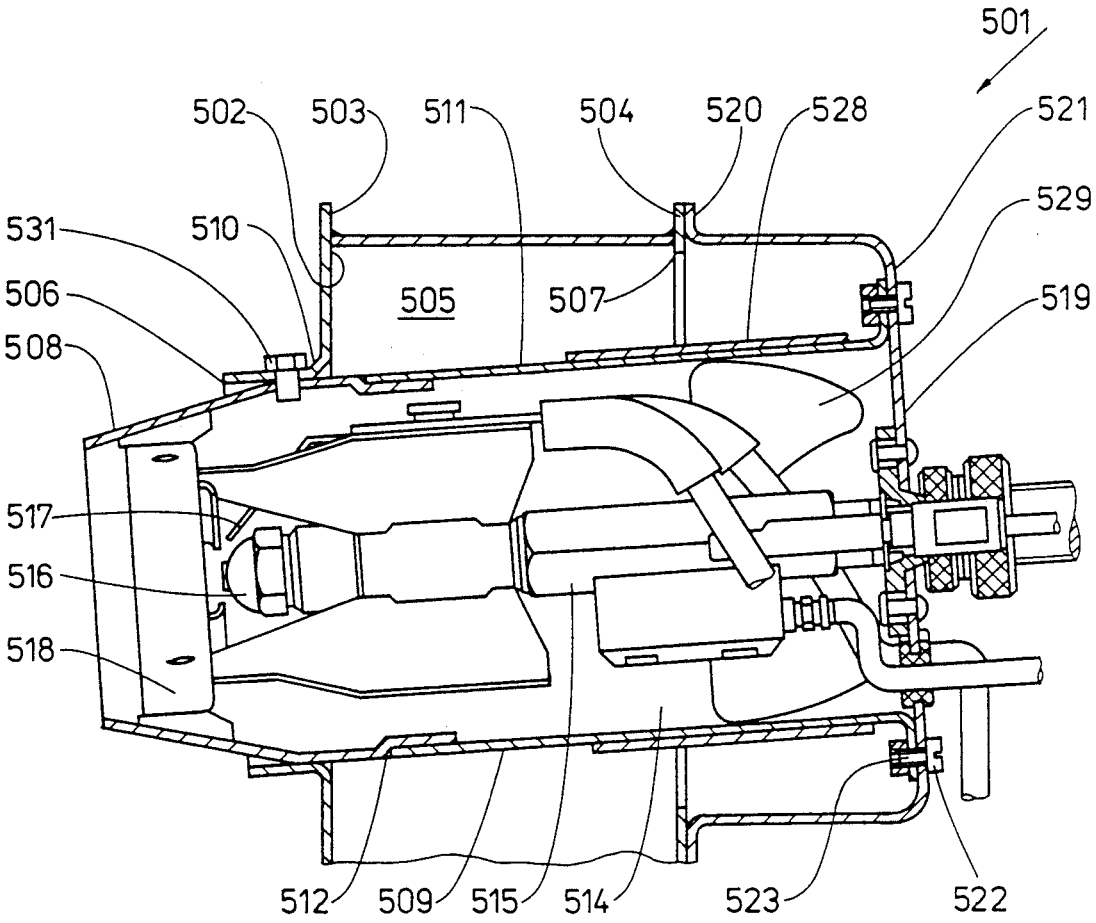
FIG. 9 is a schematic sectional view of a burner section according to the invention.

An oil blower burner 501 according to FIG. 9 is provided with a casing 502, which comprises two side walls 503 and 504, which enclose an intermediate space 505. This intermediate space is connected to the pressure joint or part of a blower, not shown here. The side wall 503 is provided with a circular opening 506. The side wall 504 is provided with a circular opening 507 as well. Both openings are approximately aligned. A fire tube 509, which comprises two parts 510 and 511, which are subdivided in a radially running plane 512, protrudes with its burner mouth side end 508 through the opening 506. The front end 510 of the fire tube is formed as a frustum of a cone, where the smaller diameter of the cone forms the end on the burner side. The connection of the two parts 510 and 511 of the burner tube is immediate, where one end of the cylinder tube is provided as a cylinder and inserted into the other end. In this case, the front end can be placed onto the rear end, and vice versa. Instead of having the front end of the burner widened as shown in FIG. 9, it is also possible according to FIG. 10, to weld a shell ring 513 to the inner jacket of the front burner tube and to slide the rear end over said shell ring. Furthermore, the radial joint plane 512 can be formed as an inclined opening according to FIG. 11 such that the two ends 510 and 511 are weakened in the inner or, respectively, outer diameter, and that the plug connection can thus be achieved A sleeve 528 slides on the outer jacket 527 of the fire tube, which sleeve 528 can be moved in axial direction by a servomotor, not shown, and can more or less cover the openings 529. The casing element 502, in fact, exhibits the opening 506, but it is provided with a relatively strong collar 530. The end 508 of the fire tube is supported at this collar and the flange and the collar can be connected via a screw 531. The flange 520 of the cover does no longer have to be removed and released. Therefore, the flange welded to the side wall 504. The cover is provided with a central opening 532 with circular shape. The inner diameter of the opening corresponds approximately to the free inner space 514 of the fire tube. This opening can be covered with a flange 533, which has approximately the shape of a cylinder disk and which is attached to the outer side 534 of the cover 519. Three additional screws, not shown here, serve to attach the flange. These screws are disposed on a circular ring staggered relative to the screws 526. The flange is provided with outward bulgings 535 in order to cover the screws which support the fire tube at the inside of the cover 519.

Figure 13:
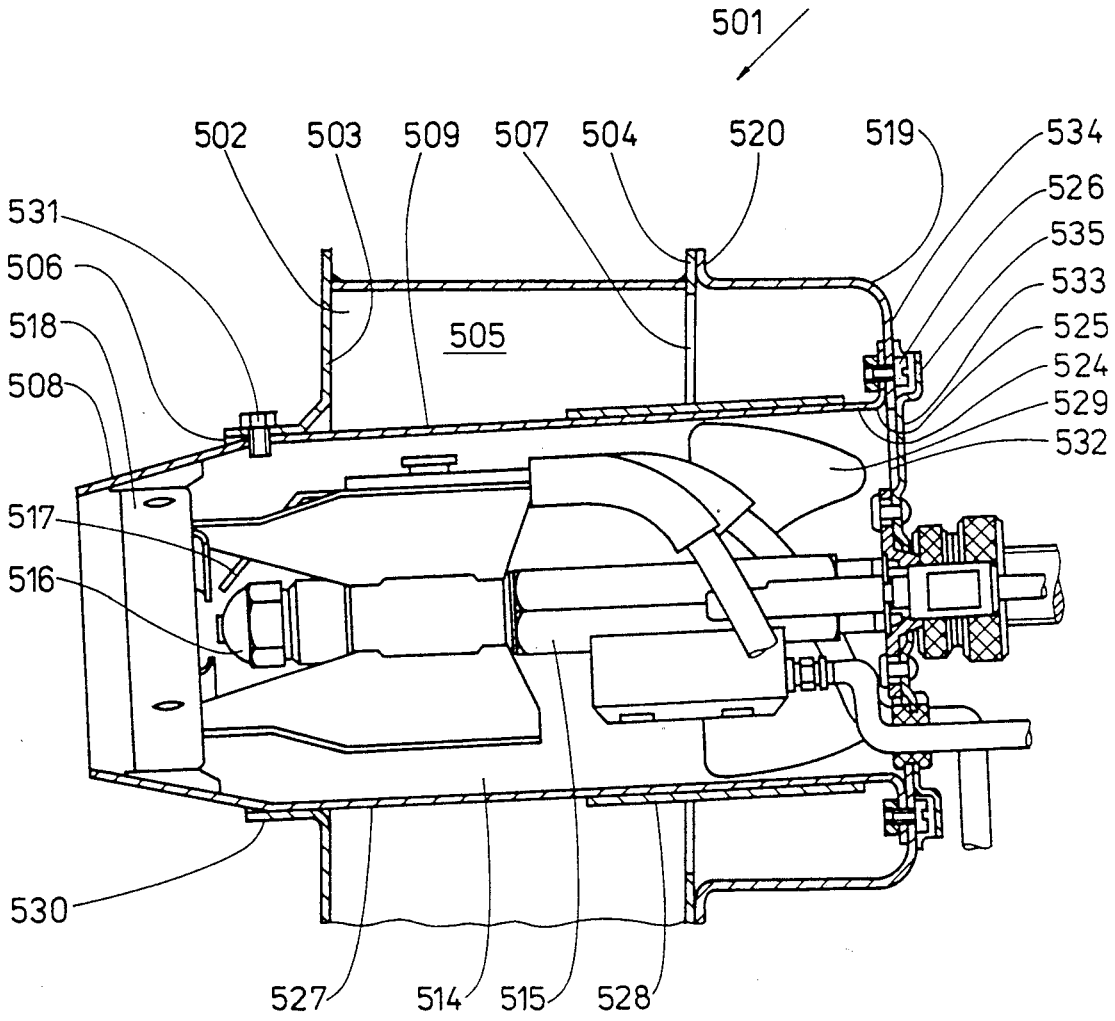
FIG. 13 is a schematic sectional view of a further burner section according to the invention.

The screws, which hold the flange 533 to the outside 534 of the cover 519, are loosened for service purposes. All elements 515 to 518 of the burner aggregate can now be pulled rearwardly from the interior space 514 of the fire tube 509, since the opening 532 in the floor of the cover is now free. Thus, all elements 515 to 518 of the burner aggregate are now free for service purposes. The features according to the embodiment of FIG. 13 rest in the realization that the fire tube can remain mounted to the casing. All elements are freely accessible for service purposes of the burner aggregate. The elements are attached to a flange cover and the flange cover itself is provided with an opening. In this way, upon removal of the flange, the complete burner aggregate can be pulled out of the inner space of the fire tube.

A fuel feed line is provided in the inner space 514 of the fire tube, possibly with an oil preheater, a fuel nozzle 516, an ignition electrode 517, as well as a baffle disk 518. These parts are all attached to the fuel feed line 515. The fuel feed line itself passes through a cover 519 and is attached to said cover. The cover is formed by a cup-shaped construction component with a flange 520 protruding in forward direction, which is attached to the outside of the side wall 504 and which covers the opening 507. The rear end 511 of the fire tube is attached to a cover plate 521, which in turn is attached to the inside of the cover 519.

The cover 519, which is demountably attached, for example via a screw 523 passing through the hole 522, can be removed by removing this connection if the inner space 514 of the fire tube 509 or, respectively, the there provided elements 515 to 517 and possibly others, are to be cleaned. 1 10 In case of a removal of the complete burner unit including cover 519, the fire tube separates in the region of the radial plane 512 and the rear end 511 of the fire tube is withdrawn together with the cover and the elements 515 to 518. The front end 510 of the fire tube remains connected to the side wall 503. The space behind the baffle disk 518 is freely accessible from all sides for service purposes after withdrawal of the burner element.

Figure 10:
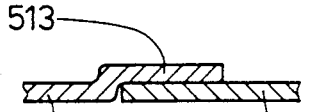
FIG. 10 is a schematic sectional view of a demountable fire tube assembly.
Figure 11:
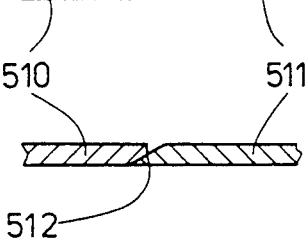
FIG. 11 is a schematic sectional view of another demountable fire tube assembly.
Figure 12:
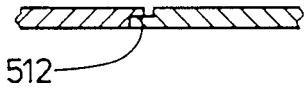
FIG. 12 is a schematic sectional view of a further demountable fire tube assembly.

The embodiment of FIG. 10 is based on another solution principle relating to the same task. Here the fire tube is provided as a single part, its front or, respectively, burner side end 508 is also formed as a frustum of a cone. Its rear end 524 is provided with an outwardly bent flange 525, which is provided with holes, through which three screws 526 grip, which are attached to the floor of the cup-shaped cover 519.

It will be understood that each of the elements described above, or two or more together, may also find a useful application in other types of heating system configurations and fuel burning procedures differing from the types described above.

While the invention has been illustrated and described as embodied in the context of a blower burner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A blower burner for a heat source comprising a blower casing having a rear opening, and a substantially planar front wall;

a blower including a fan wheel having a central axis and mounted in the blower casing;

a drive motor attached to the fan wheel at a rear side of the fan wheel with the motor protruding rearwardly on a rear wall attached to the blower casing;

a fire tube disposed in said blower casing adjacent the outer circumference of the fan wheel such as to permit direction of the output air of the fan wheel into the fire tube wherein one end of the fire tube protrudes through said front wall, and where the fire tube is disposed at a small angle versus a line perpendicular to said front wall; a nozzle disposed approximately centrally in the fire tube;

a fuel feed means disposed approximately coaxially in the fire tube for supplying fuel to the nozzle in the fire tube; and a means covering the rear opening of the blower casing, said covering means including an inside sleeve supported by said fire tube.

2. The blower burner for a heat source according to claim 1 wherein the means covering the rear opening of the blower and the blower with drive motor protrude from the rear of the blower casing.

3. The blower burner for a heat source according to claim 1 wherein the fire tube is provided with openings at its rear end, which openings can be covered by the sleeve.

4. The blower burner for a heat source according to claim 1 further comprising a servomotor disposed at the rear side of the cover for adjusting the position of the sleeve relative to openings in the fire tube.

5. A blower burner for a heat source comprising a blower casing having a rear opening and a substantially planar front wall;

a blower;

a fire tube disposed in said blower casing adjacent an outer circumference of the blower fan wheel such as to permit direction of output air into the fire tube where one end of the fire tube protrudes through said front wall and where the fire tube is disposed at a small angle versus a line perpendicular to said front wall; a fuel nozzle disposed within the fire tube for introducing fuel into the burner;

a covering means covering the rear opening of the blower casing and including an inside sleeve supported by the fire tube; and a sound absorber disposed on said front wall of the blower casing.

6. The blower burner for a heat source according to claim 5 wherein the sound absorber comprises a sheet metal casing, where an inner wall is covered with a sound absorbing material and where the inner wall is provided with at least one deflection baffle.

7. The blower burner for a heat source according to claim 5 wherein the sound absorber is provided as a shell-like recessed sheet metal part, which attaches with the open side to a front side of the casing of the blower.

8. The blower burner for a heat source according to claim 7 wherein the sound absorber is provided with two input openings disposed on opposite sides, which are connected to an air input suction opening of the blower via a deflection baffle, where the deflection baffle is provided by the end of a tongue and by a side of the sound absorber.

9. The blower burner for a heat source according to claim 5 wherein the sound absorber comprises in its interior at least two deflection baffles effective for deflecting sound waves and disposed relative to two planes vertical to each other.

10. The blower burner for a heat source according to claim 5 wherein the sound absorber comprises a casing formed as a rectangular trapezoid and where an inlet opening is provided at a narrow side and where the outlet opening is provided at a wide side.

11. A blower burner for a heat source comprising a blower casing;

a blower including a fan wheel having an axis and mounted in the blower casing;

a drive motor attached to the fan wheel at a rear side of the fan wheel with the motor protruding rearwardly on a rear wall of the blower casing;

a sleeve subdivided in axial direction and provided with a spring means for biasing the subdivided sleeve portions relative to each other;

a fire tube mounted in said blower casing associated with the sleeve and the sleeve forming an extension of the fire tube and provided with an outside surface and provided with openings, which can be covered more or less with the sleeve, and which openings are connected to an output of the blower fan wheel; and a nozzle disposed in the fire tube, an internal fuel feed connected to the fire tube for supplying fuel to a nozzle in the fire tube.

12. The blower burner for a heat source according to claim 11 wherein the sleeve is disposed at the outside surface of the fire tube and where the spring means for biasing the subdivided sleeve portions relative to each other is provided as a tension spring.

13. The blower burner for a heat source according to claim 11 wherein the sleeve rests at the inside of the fire tube and where the spring means for biasing the subdivided sleeve portions relative to each other is provided as a tension spring.

14. A blower burner for a heat source comprising a blower casing having a rear opening;

a sleeve subdivided in axial direction and provided with a spring means for biasing the subdivided sleeve portions relative to each other and where the sleeve comprises two parts, wherein two joint spaces are disposed between the two parts, and where in each case two spring means for biasing the subdivided sleeve portions relative to each other are provided;

a fire tube mounted in said blower casing associated with the sleeve and the sleeve forming an extension of the fire tube and the fire tube being provided with an outer surface and provided with openings, which can be covered more or less with the sleeve;

an internal fuel feed for supplying fuel to a nozzle in the fire tube;

means covering the rear opening of the blower casing; and means providing an outer air feed via the openings of the fire tube.

15. The blower burner for a heat source according to claim 14 wherein two joint spaces are provided between the two parts of the sleeve and where these joint spaces are covered with covering elements.

16. The blower burner for a heat source according to claim 15 wherein the spring means for biasing the subdivided sleeve portions relative to each other is attached to the covering elements.

17. The blower burner for a heat source according to claim 15 wherein the covering elements are solidly connected with a part of the sleeve and are provided with a protrusion, to which the spring means for biasing the subdivided sleeve portions relative to each other furnished as a tension spring is attached such that in each case the other part of the sleeve supports directly a protrusion to which the other end of the tension spring is attached.

18. The blower burner for a heat source according to claim 11 wherein the sleeve is provided with only a single joint space and where the sleeve itself is spring-like.

19. An oil blower burner comprising a blower casing having a planar and a rear opening;

a blower including a fan wheel mounted in the blower casing;

a drive motor attached to the fan wheel at a rear side of the fan wheel with the motor protruding rearwardly on a rear wall of the blower casing;

a fire tube disposed adjacent to the fan wheel such as to permit direction of the output air of the fan wheel into the fire tube, said fire tube having a rear end;

a cover attached at the blower casing and bulging rearwardly from the casing where the rear end of the fire tube protrudes beyond the rear wall of the casing of the blower burner in the area of the fan wheel in a direction parallel to the drive motor such that the rear end of the fire tube abuts the rear cover attached at the blower casing and wherein the rear end of the fire tube is furnished with an air entry opening;

a movable sleeve for sliding over the air entry opening, wherein the air entry opening and the movable sleeve serve to provide a pre-control of the burner air feed throughput and wherein the air entry opening can be adjustably covered with said sleeve and where the sleeve can be interposed into the air feed path from the blower to the air entry opening, and wherein the combustion air is in part over some section of its path between the blower and the air entry opening of the fire tube transported in a direction having a substantial component directed opposite relative to the flow direction within the flame tube.

20. The oil blower burner according to claim 19 wherein the air feed path is formed in part by an annular space between the cover and a periphery of the fire tube.

21. The oil blower burner according to claim 19 wherein the fire tube is provided with openings at its rear end, which openings can be covered by the sleeve.

22. The oil blower burner according to claim 19 further comprising a servomotor disposed at the rear side of the cover for adjusting the position of the sleeve relative to openings in the fire tube.

23. The oil blower burner according to claim 19 further comprising a pressure controller for the static pressure present at the mouth in the flame tube between the sleeve and a baffle disk, where the input control value of the pressure controller is derived from sensing means sensing the air pressure in the inner space of the fire tube and where the controlled variable is the rotation speed of the fan wheel of the blower.

24. The oil blower burner according to claim 23 further comprising a pressure measurement joint disposed at the fire tube;

a transducer connected to the pressure measurement joint and to the pressure controller.

25. The oil blower burner according to claim 19 further comprising a fuel supply line having an output end;

a nozzle attached to the output end of the fuel supply line;

an ignition electrode disposed adjacent to the nozzle;

a baffle disk; and a flange attached to the outer part of the cover part supporting the fuel supply line, the nozzle, the ignition electrode and the baffle disk and wherein the fire tube is supported at its backside at the inner side of the cover part of the casing.

26. The oil blower burner according to claim 25 further comprising attachment elements for the fire tube; and where the flange is provided as a planar cover plate, which covers the attachment elements of the fire tube.

27. The oil blower burner for a heat source according to claim 25 wherein the flange supports feedthroughs for all elements protruding into the fire tube.

28. An oil blower burner comprising a blower casing having a rear opening and a substantially planar front wall;

a blower casing having a rear opening and a substantially planar front wall;

a blower including a fan wheel mounted in the blower casing;

a drive motor attached to the fan wheel at a rear side of the fan wheel with the motor protruding rearwardly on a rear wall of the blower casing;

a fire tube mounted to the casing slightly inclined downwardly relative to a line perpendicular to said substantially planar front wall for a boiler such as to consume any dripping fuel at a front hot end of the fire tube; and a pressure controller where the measurement input values are derived from sensing the air pressure inside of the fire tube with a measurement sensor and where the output of the pressure controller provides set point adjustment values for the blower speed.

29. The oil blower burner according to claim 28 further comprising a pressure measurement joint disposed at the fire tube;

a transducer connected to the pressure measurement joint and to the pressure controller.

30. The oil blower burner according to claim 28 wherein the pressure controller, the fire tube and the blower are integrated into a single unit.

31. The oil blower burner according to claim 28 wherein the measurement values employed are the differences of the air pressures between the inner space of the fire tube and the atmosphere or, respectively, of the air pressures between the fire tube and the exhaust pipe.

32. The oil blower burner according to claim 31 wherein the pressure controller is connected to the measurement sensor for sensing differences of air pressures.

33. An oil blower burner comprising a blower casing having a rear opening and a substantially planar front wall;

a blower including a fan wheel mounted in the blower casing;

a drive motor attached to the fan wheel at a rear side of the fan wheel with the motor protruding rearwardly on a rear wall of the blower casing;

a fire tube disposed approximately in parallel to and nearby the outer circumference of the blower such as to permit direction of the output air of the fan wheel into the fire tube, wherein a front end of the fire tube is disposed at a lower level as compared to the input side end and relative to a line perpendicular to said front wall, and where the rear wall of the fire tube protrudes from the rear wall of the blower casing, which wall is directed to the motor;

a nozzle disposed approximately centered in the fire tube; a fuel feed disposed approximately centered in the fire tube for supplying fuel to the nozzle in the fire tube; and a cover means of the blower casing covering the rear opening of the blower casing into which the rear side of the fire tube protrudes.

34. The oil blower burner according to claim 33 further comprising a conical taper provided at the fire tube, where the transition point between the conical taper and the fire tube is the lowest point of the fire tube.

35. An oil blower burner comprising a blower casing having a rear opening;

a blower including a fan wheel mounted in the blower casing;

a drive motor attached to the fan wheel at a rear side of the fan wheel with the motor protruding rearwardly on a rear wall attached to the blower casing;

a fire tube which is disposed approximately in parallel to and nearby the outer circumference of the blower such as to permit direction of the output air of the fan wheel into the fire tube and which is radially subdivided and with its back side attached to a part of the blower casing and where a front part of the fire tube can be removed;

a nozzle disposed approximately centered in the fire tube;

a fuel feed disposed approximately centered in the fire tube and connected to the nozzle for supplying fuel to the nozzle in the fire tube; and a cover means of the blower casing covering the rear opening of the blower casing into which the rear side of the fire tube protrudes;

a cover part forming part of the casing and provided with a recess where the fire tube is supported at its backside at the inner side of the cover part of the casing;

an ignition electrode;

a baffle disk; and a flange attached to the outer part of the cover part supporting the fuel supply line, the nozzle, the ignition electrode and the baffle disk.

36. The oil blower burner according to claim 35 further comprising a bearing for the front part of the fire tube, which is formed immediately on the rear part of the fire tube.

37. The oil blower burner according to claim 35 further comprising attachment elements for the fire tube; and where the flange is provided as a planar cover plate, which covers the attachment elements of the fire tube.

38. The oil blower burner according to claim 35 wherein the flange supports feedthroughs for all elements protruding into the fire tube.

39. An oil blower burner comprising a blower casing having a planar rear wall and a rear opening;

a blower including a fan wheel mounted in the blower casing;

a drive motor attached to the fan wheel at a rear side of the fan wheel with the motor protruding rearwardly on a rear wall attached to the blower casing;

a fire tube which is disposed approximately in parallel to and nearby the outer circumference of the blower such as to permit direction of the output air of the fan wheel into the fire tube and which is radially subdivided and with its central portion attached to a part of the blower casing and where a front part of the fire tube can be removed, wherein a rear end of the fire tube protrudes beyond the rear wall of the casing of the blower burner in the area of the fan wheel in a rear direction parallel to the drive motor such that the rear end of the fire tube abuts the rear cover attached at the blower casing and wherein the rear end of the fire tube is furnished with an air entry opening and a movable sleeve for sliding over the air entry opening, wherein the air entry opening and the movable sleeve serve to provide a pre-control of the burner air feed throughput and wherein the air entry opening can be adjustably covered with said sleeve and where the sleeve can be interposed into the air feed path from the blower to the air entry opening, and wherein the combustion air is in part over some section of its path between the blower and the air entry opening of the fire tube transported in a direction having a substantial component directed opposite relative to the flow direction within the flame tube.

* * * * *